US007469751B2

(12) United States Patent
Gien

(10) Patent No.: US 7,469,751 B2
(45) Date of Patent: Dec. 30, 2008

(54) PNEUMATIC HAMMER

(76) Inventor: Bernard Lionel Gien, Nos. 2 & 4 Simba Street, Sebenza Edenvale 1610 (ZA)

( * ) Notice: Subject to any disclaimer, the term of this patent is extended or adjusted under 35 U.S.C. 154(b) by 0 days.

(21) Appl. No.: 11/128,098

(22) Filed: May 12, 2005

(65) Prior Publication Data

US 2005/0252671 A1 Nov. 17, 2005

(30) Foreign Application Priority Data

May 17, 2004 (ZA) ..... 2004/3744

(51) Int. Cl.
*B23Q 5/06* (2006.01)

(52) U.S. Cl. ..... 173/15; 173/17; 173/91

(58) Field of Classification Search ..... 173/15, 173/17, 91; 175/296, 297; 91/234
See application file for complete search history.

(56) References Cited

U.S. PATENT DOCUMENTS

| | | | | |
|---|---|---|---|---|
| 4,402,370 A | | 9/1983 | Gein et al. | |
| 5,562,170 A | | 10/1996 | Wolfer et al. | |
| 5,984,021 A | * | 11/1999 | Pascale | 173/90 |
| 6,050,347 A | * | 4/2000 | Jenne | 173/91 |
| 6,550,554 B2 | * | 4/2003 | Gien | 175/296 |
| 2002/0011360 A1 | | 1/2002 | Gien | |

FOREIGN PATENT DOCUMENTS

| | | |
|---|---|---|
| EP | 0 549 549 A1 | 12/1992 |
| EP | 1 462 604 A2 | 9/2004 |
| ZA | 81/3065 | 5/1981 |

* cited by examiner

*Primary Examiner*—Rinaldi I. Rada
*Assistant Examiner*—Nathaniel Chukwurah
(74) *Attorney, Agent, or Firm*—J. Harold Nissen; Lackenbach Siegel, LLP

(57) ABSTRACT

A pneumatic hammer comprises an elongate hollow casing with operatively upper and lower ends and has a piston slidingly received within the casing and operable to reciprocate within the casing between upper and lower pressure chambers defined within the casing. The hammer further has an axially displaceable bit assembly at the lower end of the casing and a backend assembly at the upper end of the casing. The piston has a striking face at an end thereof proximate the bit assembly, and the piston is operable to impact on a contact surface of the bit assembly in an impact region of the casing. The hammer is characterized in that the piston is shaped and dimensioned at its proximal end to have a snug sliding fit with an interior of the casing in the impact region of the casing.

2 Claims, 2 Drawing Sheets

PNEUMATIC HAMMER

FIELD OF THE INVENTION

This invention relates to a hammer. More particularly, the invention relates to a valveless pneumatic hammer which is generally used for "down the hole" drilling in mines and the like.

BACKGROUND TO THE INVENTION

Many types of pneumatic hammer are available and are used, particularly but not exclusively, in the drilling of blast holes in mining applications. The applicants' earlier South African Patent No. 81/3065 describes such hammers and the contents of the specification of this earlier patent is incorporated herein in its entirety by reference.

Generally, a pneumatic hammer of the type described, also known as a down-hole hammer drill, comprises a hollow casing with operatively upper and lower ends. A piston is slidingly received within the casing to reciprocate between upper and lower pressure chambers defined within the casing. The hammer also has a bit assembly at the lower end of the casing and a backhead assembly at the upper end of the casing. The bit assembly is axially displaceable with respect to the casing. The piston of the hammer has a striking face at an end thereof proximate the bit assembly. The striking face of the piston is configured to strike a contact surface of the bit assembly, thereby urging the bit assembly to be displaced axially with respect to the casing and into the medium being drilled.

Generally, the contact surface of the bit assembly is narrower in diameter than the interior diameter of the hammer casing and the striking face of the piston has a diameter substantially similar to that of the contact surface of the bit assembly. It will be appreciated by those skilled in the art that in this configuration undesirable lateral forces may be generated on impact between the piston and the bit assembly causing them to be displaced laterally within the casing, thereby causing wear on the casing and sliding components at the points of contact thereof.

OBJECT OF THE INVENTION

It is an object of the invention to provide a pneumatic hammer, which, at least partially, overcomes the abovementioned problem.

SUMMARY OF THE INVENTION

According to the invention there is provided a pneumatic hammer comprising an elongate hollow casing with operatively upper and lower ends and having a piston slidingly received within the casing and operable to reciprocate within the casing between upper and lower pressure chambers defined within the casing, the hammer further having an axially displaceable bit assembly at the lower end of the casing and a backend assembly at the upper end of the casing, and the piston having a striking face at an end thereof proximate the bit assembly, the piston being operable to impact on a contact surface of the bit assembly in an impact region of the casing, the hammer characterized in that the piston is shaped and dimensioned at its proximal end to have a snug sliding fit with an interior of the casing in the impact region of the casing.

An end portion of the bit assembly on which the contact surface is defined may be of a smaller diameter than the interior of the interior of the casing in the impact region of the casing and the proximal end of the piston may have a longitudinally extending annular lip, the contact end portion of the bit assembly being received within the lip of the piston.

Further, the lip of the piston may widen from its free end towards the proximal end of the piston to define an inner surface which, in cross-section through an axis of the piston, is angled with respect to the said axis, the lip thereby providing a guide for the contact end portion of the bit assembly.

BRIEF DESCRIPTION OF THE DRAWINGS

The invention is now described, by way of example, with reference to the accompanying diagrammatic drawings, in which.

DETAILED DESCRIPTION OF THE DRAWINGS

Figure 1:
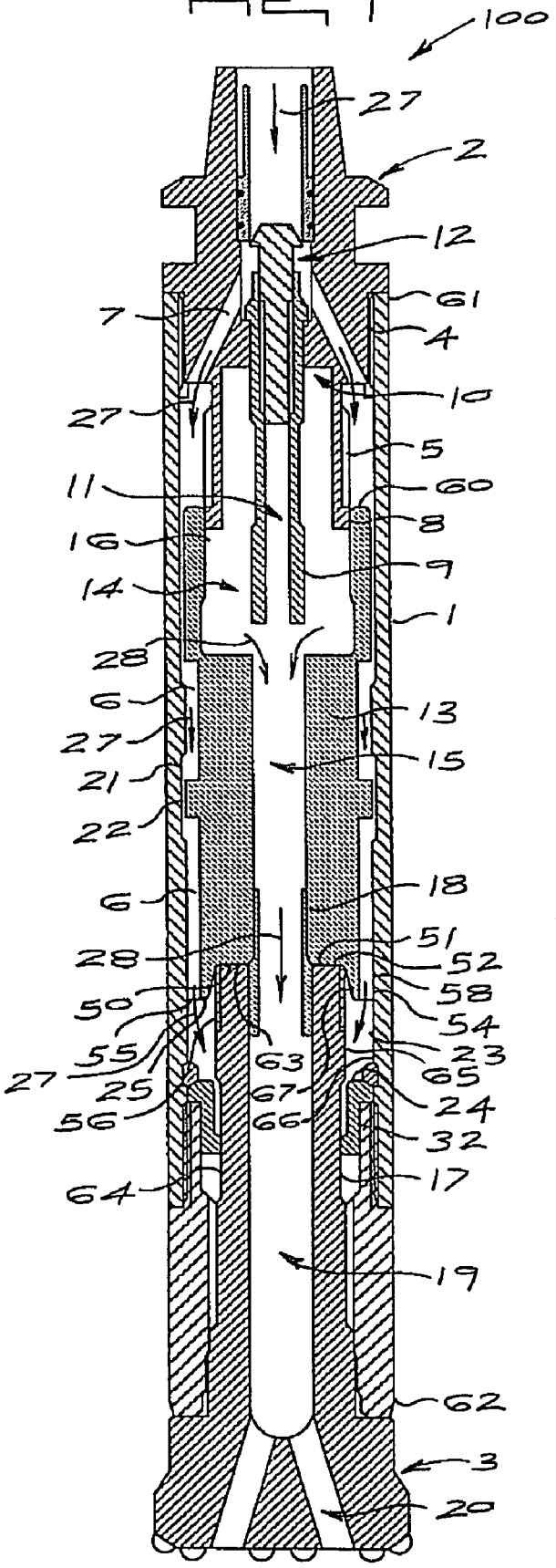
FIG. 1 shows a sectional side view of a first embodiment of a pneumatic hammer, in accordance with the invention, with its piston in a first, striking position.
Figure 2:
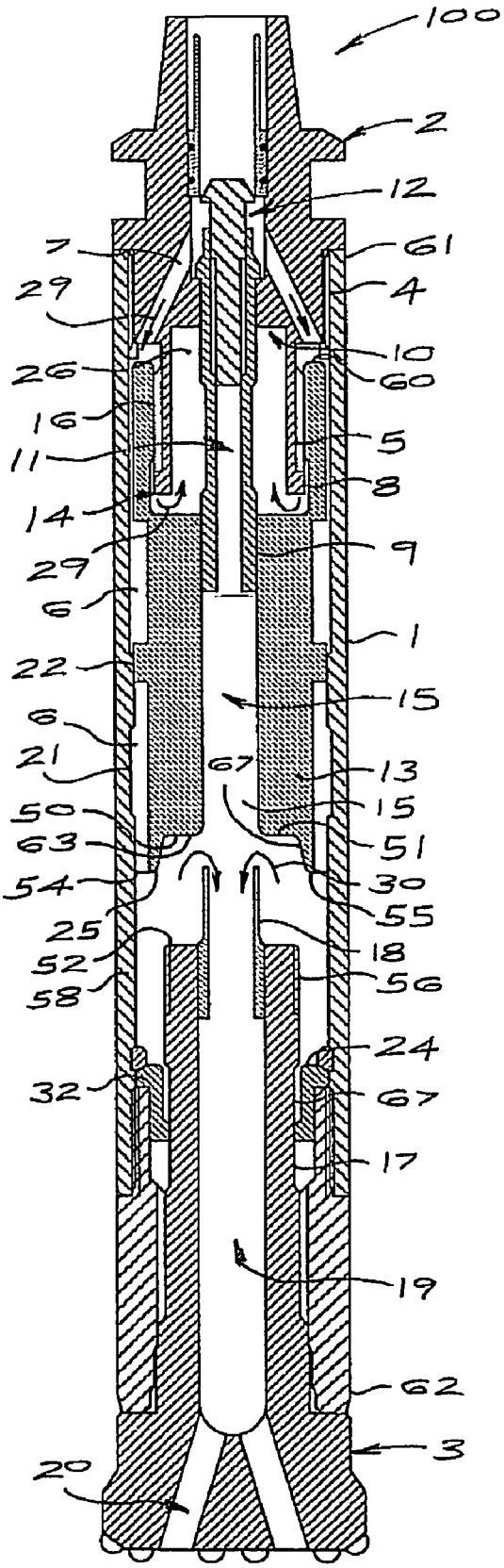
FIG. 2 shows a sectional side view of the hammer of FIG. 1 with its piston in a second, non-striking, position.

In FIGS. 1 and 2 of the drawings, reference numeral 100 generally indicates a pneumatic hammer of the downhole type, in accordance with the invention.

The hammer 100 comprises a hollow, generally cylindrical casing 1 having a backhead assembly 2 at an upper end 61 thereof and a bit assembly 3 at the other, lower end 62. The backhead assembly 2 is secured in the casing end by internal screw-threading 4 in the casing 1. The backhead assembly 2 has a chamber divider 5 extending axially into the casing 1. Inlet passages 7 are defined in the backhead assembly 2. The chamber divider 5 has an outwardly stepped portion 8 at its free end. A central control rod 9 projects axially from the backhead assembly. An annular control rod 9 projects axially from the backhead assembly. An annular recess 10 is defined in the backhead assembly 2 around the central control rod 9. A central bore 11 extends through the control rod 9 from its free end to a non return valve assembly 12 in the backhead assembly 2.

Further, the hammer 100 has a piston 13, which has a large bore 14 in a first end 60 thereof and a smaller bore 15 in the other, second end 63 thereof and extending through to the larger bore 14. The large bore 14 of the piston 13 is inwardly stepped to provide a narrower region 16 of the bore 14 at the first end 60 of the piston 13. The narrower region 16 of the piston 13 is slidable in an airtight manner over the outer surface of the outwardly stepped section 8 of the chamber divider 5.

The bit assembly 3 has a shaft 17, at the end of which is a protruding hollow rod 18, which is receivable within the small bore 15 of the piston 13. The bit assembly 3 is slidable within the casing 1 between predetermined limits. A portion of the shaft 17 extends into the casing interior past a stepped section 24 of the casing 1, provided by an insert 32, and the bit assembly 3 may move between a raised position in which the said shaft portion is fully inserted into the casing interior (as shown in FIGS. 1 and 2) and a lowered position (not shown) where the shaft portion is partially withdrawn. The insert 32 engages with a recessed portion 64 of the shaft 17 and the recessed portion 64 and insert 32 together limit the extent of displacement of the bit assembly 3.

A passageway 19 passes through the projecting rod 18 and the shaft 17 and divides into separate passages 20 in the outer portion of the bit assembly 3. These passages 20 are in communication with atmosphere at the end of the bit assembly 3.

An annular recess 21 is defined in an interior wall of the casing 1, near the centre of the casing 1. The piston 13 has, in effect, an outwardly stepped, annular portion 22, formed by circumferentially spaced slots 6 cut into the piston 13 above and below the stepped portion 22, the slots forming fluid passages above and below the outwardly stepped annular portion 22.

The piston 13 is adapted to reciprocate between two positions. In the first position (FIG. 1), the piston 13 abuts the bit assembly 3 in its raised condition, and with the bit assembly rod 18 extending fully into the small bore 15 of the piston 13. In this position a first, lower pressure chamber 23 is formed around the bit assembly 3 and is defined by the wall of the bit assembly at this position 65, the casing wall opposite it 66, the insert 32 and a proximal end portion 25 of the piston 13. In this position, the recess 21 is in communication with the first chamber 23 via the slots 6. The outwardly stepped portion 8 of the chamber divider 5 and the inwardly stepped portion 16 of the piston 13 are in register and seal off the large bore 14 of the piston 13, and the annular recess 10 of the chamber divider, from the remainder of the interior of the casing 1.

In the second position of piston movement (FIG. 2) the piston 13 is displaced towards the backhead assembly 2, the projecting rod 18 of the bit assembly 3 is removed from the small bore 15 of the piston, and the inwardly stepped section 16 of the piston 13 has now slid past the outwardly stepped portion 8 of the chamber divider 5 and they are no longer in register. In this position, the control rod 9 of the chamber divider 5 is within the small bore 15 of the piston 13, and the casing recess 21 is sealed off from the upper interior of the casing 1 by the piston stepped portion 22. A second, upper pressure chamber 26 is formed with the piston 13 in this position and is defined by the large bore 14 of the piston 13 and the recess 10 in the chamber divider 5.

A first fluid supply path is defined, with the piston 13 in its first position, through the backhead assembly 2, and continues between the chamber divider 5 and the casing walls into the slots 6 and then into casing recess 21, and then into the first pressure chamber 23. This first fluid supply path is indicated by the arrows 27 in FIG. 1 of the drawings.

A second fluid supply path is defined, with the piston 13 in its second position (FIG. 2), and passes through the backhead assembly 2, between the chamber divider 5 and casing wall and between the inner wall of the large bore 14 of the piston 13 and the outer wall of the chamber divider 5, into the second chamber 26. This path is indicated by arrows 29 in FIG. 2.

A first fluid exhaust path is defined, with the piston 13 in its second position, and passes from erstwhile position of the first chamber 23 (FIG. 1), directly into the passage 19 in the bit assembly 3 and via the passages 20 out to atmosphere. This exhaust path is indicated by arrows 30 in FIG. 2.

A second fluid exhaust path is defined, with the piston 13 in its first position, and passes from the erstwhile position of the chamber 26 (FIG. 2) into the small bore 15 of the piston 13, from there into the passage 19 in the bit assembly 3 and out to atmosphere via the passages 20. The exhaust path is indicated by arrows 28 in FIG. 1.

In use, air under pressure is admitted to the casing 1 by the backhead assembly 2 and passes along the first fluid supply path 27 into the first pressure chamber 23, where the pressure causes the piston 13 to move towards the backhead assembly 2 and position two. The area of the piston surface exposed to pressure in chamber 23 is larger than the area of end surface of the piston 13 at its large bore end. As the piston 13 moves towards its second position the rod 18 is removed from the small bore 15 of the piston 13 and air from the first chamber 23 follows the first fluid exhaust path 30. Further, as the piston 13 moves towards its second position, the second fluid supply path 29 is opened by the inwardly stepped section 16 of the piston 13 moving past the outwardly stepped section 8 of the chamber divider 5. Air follows this path 29 into the second pressure chamber 26. The pressure in this pressure chamber 26 causes the piston 13 to commence moving back towards the bit assembly 3. Once the piston 13 has moved sufficiently far, the projecting rod 9 of the chamber divider 5 is removed from the small bore 15 of the piston 13, and the second fluid exhaust path 28 is open. Air from the chamber 26 exhausts along this path 28 out of atmosphere. It will be appreciated that the recess 10 increases the volume of chamber 26 and thus reduces a build up of pressure caused by the piston 13 returning to its second position. Further, air following both of the fluid exhaust paths 30, 28 passes through the bit assembly 3 and thus serves to continuously remove drilling material from the borehole that may have lodged therein whilst the hammer is drilling.

The piston 13 has an annular striking face 50 at its proximal end 51. The shaft 17 of the bit assembly 3 has an annular contact surface 52 configured to abut the striking face 50 of the piston 13. Further, an annular lip 54 extends axially from the proximal end 51 of the piston 13. The lip 54 of the piston 13 widens from its free end 55 towards the proximal end 51 of the piston to define an inner surface 67 which, in cross-section through an axis of the piston 13, is angled with respect to the said axis, the lip 54 thereby providing a guide for a free end portion 56 of the shaft 17. Further, the proximal end portion 25 of the piston 13 occupies substantially the entire bore of the casing 1 at an impact region 58 of the casing 1. The impact region 58 is a region of the interior wall of the casing opposite the point of impact between the piston 13 and the bit assembly 3, as illustrated in FIG. 1.

Figure 3:
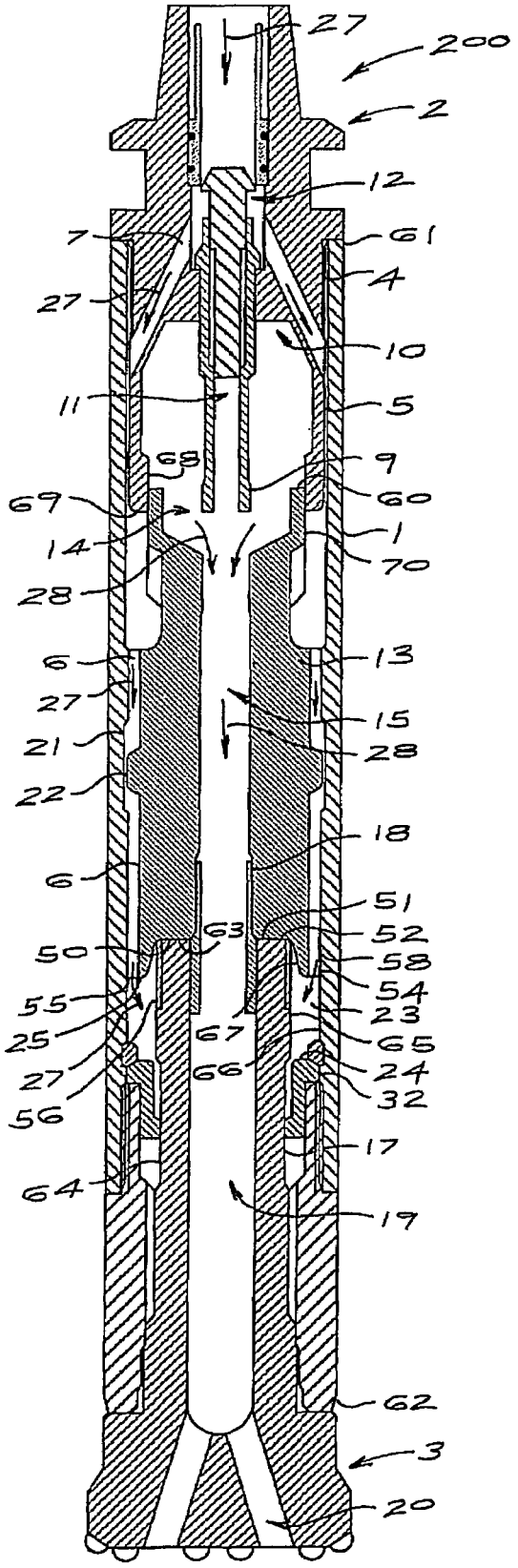
FIG. 3 shows a sectional side view of a second embodiment of the pneumatic hammer, in accordance with the invention, with its piston in a first, striking position.
Figure 4:
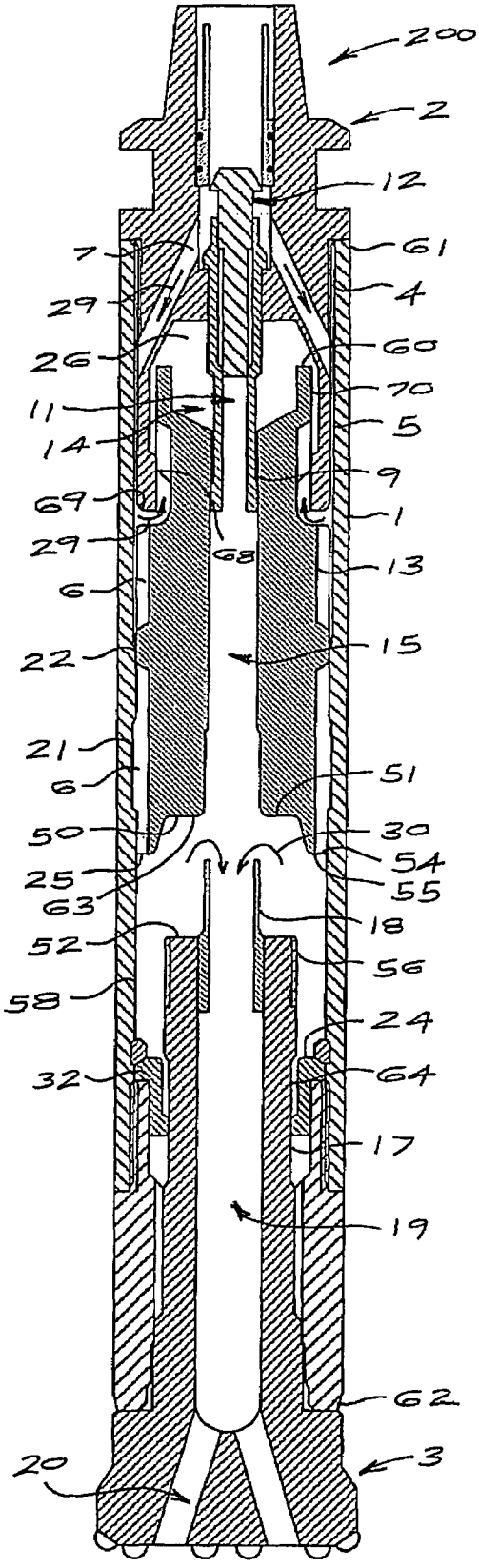
FIG. 4 shows a sectional side view of the hammer of FIG. 3 with its piston in a second, non-striking, position.

We turn now to FIGS. 3 and 4, in which a second embodiment 200 of the pneumatic hammer, in accordance with the invention, is shown. In FIGS. 3 and 4, with reference to FIGS. 1 and 2, like numerals indicate like components, unless otherwise specified.

The hammer 200 of FIGS. 3 and 4 is similar to that of FIGS. 1 and 2, with the exception that the distal end 60 of the piston 13 is received within the chamber divider 5. Thus, the chamber divider 5 has an inwardly stepped portion 68 at its free end 69, which engages with an outwardly stepped portion 70 at the distal end 60 of the piston 13, which defines the large bore 14 of the piston 13. Further, the second fluid supply path defined with the piston 13 in its second position (FIG. 4) passes through the backhead assembly 2 and then between the chamber divider 5 and casing wall, thence between the outer wall of the large bore 14 of the piston 13 and the inner wall of the chamber divider 5, into the second chamber 26. This path is indicated by arrows 29 in FIG. 4. The remaining fluid supply and exhaust paths are as described with reference to FIGS. 1 and 2.

As a result of the proximal end 51 of the piston 13 occupying the entire bore of the casing 1 in the impact region 58, lateral movement of the piston 13 on impact is reduced. Also, the lip 54 constrains the bit assembly 3 against lateral movement. Further, the piston 13 is in sliding contact with the wall of the casing 1 at the proximal end 51 of the piston 13, thereby providing support for the piston 13 and allowing advantages to be achieved in the manufacture of the air flow paths in the piston and casing. Thus, the side wall surfaces of the piston 13 at its distal end need not be in sliding contact with the casing

1, since the piston 13 is supported at its proximal end 51. Thus, the bore of the casing 1 at its upper end and the recessed portion 21 of the casing 1 do not need grinding or honing. Further, the slots or grooves 6 in the piston 13 need not be defined in parts of the piston 13 where its walls are relatively thin, such as the portion of the piston 13 having the large bore, but may be defined in a solid portion of the piston 13, as shown in the drawings.

The invention claimed is:

1. A pneumatic hammer comprising an elongated hollow casing with operatively upper and lower ends and having a piston slidingly received within the casing and operable to reciprocate between upper and lower pressure chambers defined within the casing, the hammer further having a bit assembly axially displaceable within the lower end of the casing and a backhead assembly at the upper end of the casing, the piston having a striking face at an end thereof proximate the big assembly, with an air supply path to the lower pressure chamber extending around the proximal end of the piston between the piston and an interior of the casing, the piston being operable to impact on a contact surface of the bit assembly in an impact region of the casing, and wherein the piston is shaped and dimensioned at its proximal end to have a snug sliding fit with the interior of the casing in the impact region of the casing;

wherein an end of the bit assembly defining a contact surface has a diameter smaller than the interior of the impact region of the casing;

and the proximal end of the piston has a longitudinally extending annular lip, the contact end portion of the bit assembly being received within the extending annular lip of the piston; and said lip of the piston widens from terminal end towards the proximal end of the piston to define an inwardly tapered annular surface which provides a guide for the contact end portion of the bit assembly.

2. A pneumatic hammer as claimed in claim 1, in which the sliding snug fit of the proximal end of the piston with the interior of the casing is maintained throughout reciprocation of the piston within the casing.

* * * * *